United States Patent [19]

Muller

[11] Patent Number: 5,025,867

[45] Date of Patent: Jun. 25, 1991

[54] STAKE PULLER

[76] Inventor: Laszlo Muller, 1126 Washington Ave., Allentown, Pa. 18013

[21] Appl. No.: 552,881

[22] Filed: Jul. 16, 1990

[51] Int. Cl.[5] ..... B65D 9/00

[52] U.S. Cl. ..... 173/90; 173/91; 173/128

[58] Field of Search ..... 173/90, 91, 128, 132; 29/254; 254/18, 19

[56] References Cited

U.S. PATENT DOCUMENTS 2,779,089 1/1957 Allen ..... 173/91 X 3,120,292 2/1964 Rambat ..... 173/91 X 3,791,012 2/1974 Jenkin ..... 173/91 X

*Primary Examiner*—Timothy V. Eley

*Assistant Examiner*—Willmon Fridie, Jr.

*Attorney, Agent, or Firm*—John J. Selko

[57] ABSTRACT

A stake puller having a slotted, planar base with a horizontally extending handle and a vertically extending slide bar, the centerline of the handle and slide bar being in the same vertical plane. The slot has angled sidewalls to grip a stake and a hammer head slides back and forth on the slide bar to transmit pulling force to a stake.

6 Claims, 2 Drawing Sheets

47
43
33
31
57
41
53
51
55
59
45
49
5
13
23
9
25
80°
7
27
29
39
37
35
47
43
61
51

STAKE PULLER

BACKGROUND OF THE INVENTION

1. Field of the Invention

This invention relates to devices for removing from the ground pins, or stakes, used to assemble and anchor forms for the casting of concrete structures such as sidewalks, curbs and foundations. Such stakes are driven into the ground by means of a hammer and must be extracted to later disassemble the forms. The extraction of such stakes is a difficult and time consuming job.

2. Description of the Prior Art

Prior art stake devices having elements similar to the invention are typically shown in U.S. Pat. Nos. 3,211,240; 4,261,424; 3,712,389. Such prior art devices are not completely suitable for stake extractors because they do not effectively arrange in combination and particular location all structural elements, so as to grip the stake effectively, and remove it with minimum effort.

OBJECTS

It is an object of this invention to provide a stake puller that effectively grips conventionally designed stakes.

A further object of this invention is to provide a stake puller that arranges structural elements to most effectively grip stakes and transmit pulling force thereto.

These and other objects of this invention will become apparent to those skilled in the relevant art upon reading the following specifications in conjunction with the accompanying drawings.

SUMMARY OF THE INVENTION

These and other objects are provided in a stake puller having a slotted planar base member, with a horizontally extending handle and vertically extending slide bar.

The centerlines of the handle and slide bar are positioned in the same vertical plane. A hammer head reciprocates on the slide bar for applying force to a stake positioned in the slot, and gripped by the sidewalls of the slot.

DETAILED DESCRIPTION OF THE PREFERRED EMBODIMENT

Figure 1:
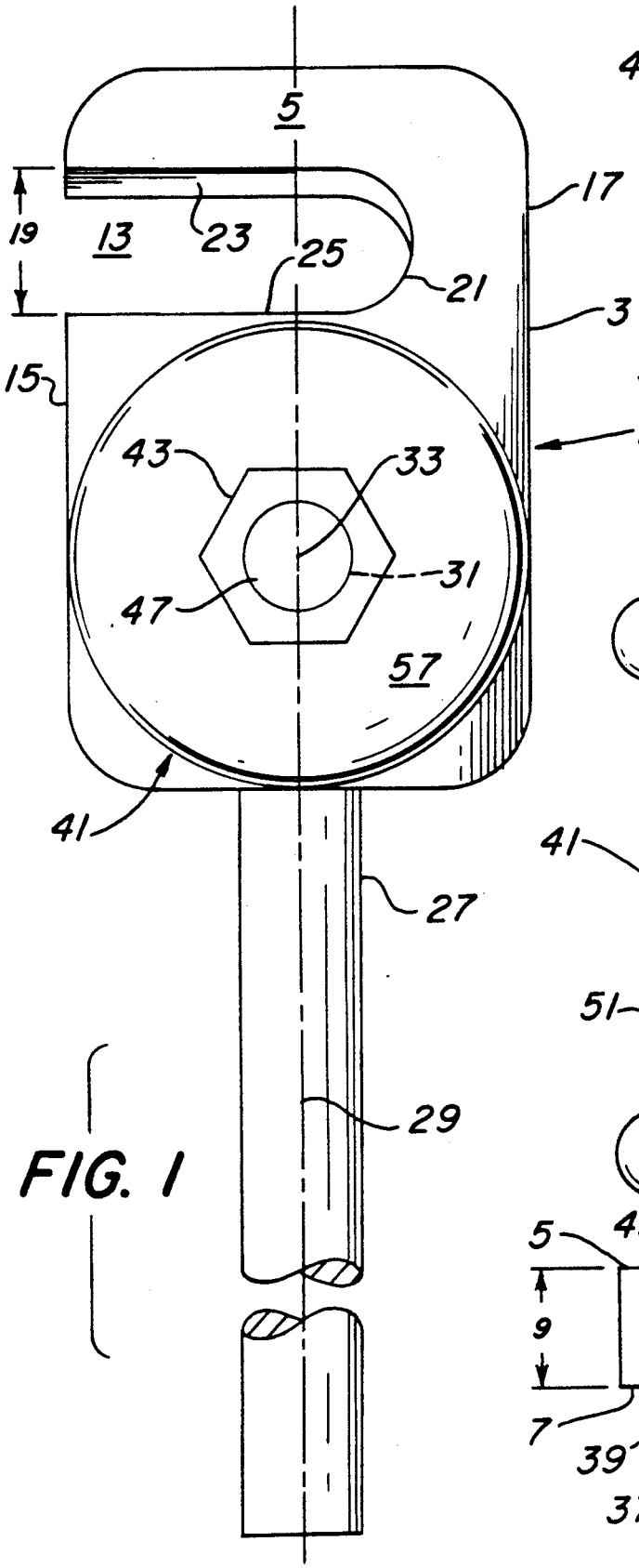
FIG. 1 is a plan view of the invention.

Referring to the Figures, the device 1 is shown to have a planar base member 3, with a top surface 5, a bottom surface 7 substantially parallel thereto, and a thickness formed by a side perimeter surface 9 extending between top surface 5 and bottom surface 7.

A slot 13 extends through thickness 9 of base member 3. Slot 13 extends linearly from a first perimeter side portion 15 toward a second perimeter side portion 17. Slot 13 has an open end 19 at first perimeter side portion 15, a closed end 21 adjacent to second perimeter side portion 17 and a pair of spaced apart, parallel, sidewalls 23 and 25 between open end 19 closed end 21.

A horizontaly extending elongated handle 27 is attached to base member 3 by suitable means, such as welding. Handle 27 has a centerline 29 that passes substantially through the center of base member 3, and perpendicular to the linear direction of the sidewalls 23 and 25 of slot 13. As used herein, the term center means generally the center of gravity of base member 3. Centerline 29 is also located on a horizontal plane substantially parallel to, or exactly on, the plane of base member 3, as viewed from a front elevational view with base member horizontal. (See FIG. 3)

The term substantially means that there is a reasonable plus or minus variation in location around the geometrically exact point of reference, so long as the function of the device is not impaired.

Figure 2:
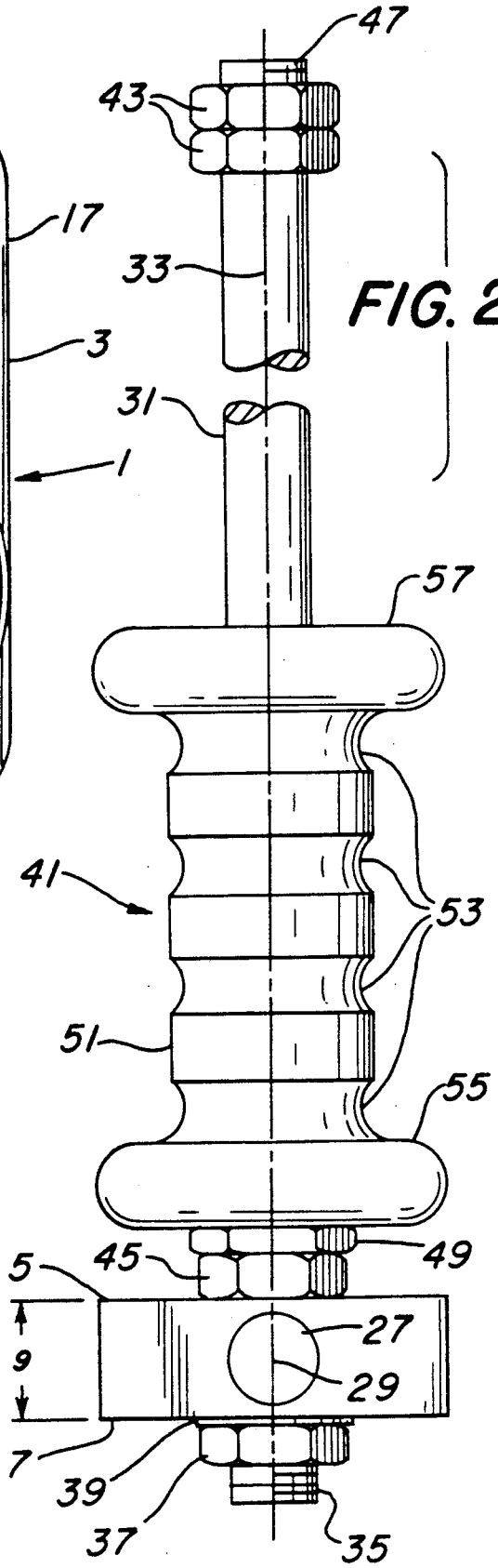
FIG. 2 is a side elevational view of FIG. 1.

An elongated tubular slide bar 31 is removably attached to base member 3 between slot 13 and handle 27. Slide bar 31 extends vertically upward from base member 3 and top plane 5, being at substantially a right angle thereto. Centerline 33 of slide bar 31 and centerline 29 of handle 27 are located in substantially the same vertical plane, as viewed from a side elevational view, with base member substantially horizontal. (See FIG. 2). I prefer to removably attach slide bar 31 to base member 3, in order to permit changing of length of slide bar 31 to suit conditions. Slide bar 31 is attached to base member 3, by means of a threaded end 35 extending through an aperture in base member 3 to a nut 37 and washer 39 combination, as is well known.

Hammer means 41 is slidably telescoped on slide bar 31 for reciprocating back and forth between a pair of oppositely spaced stops 43 and 45. First stop 43 is a pair of nuts threaded on to end 47 of slide bar 31. Second stop 45 is a nut threaded onto slide bar 31 with a washer 49 between nut 45 and hammer head 51. Hammer head 51 has gripping grooves 53 therein and a protruding base 55 and top end 57, to retain the hand of the user thereon for safety.

The overlapping planar alignment of centerline 29 of handle 27 and centerline 33 of slide bar 31, in combination with the location of slide bar 31 between handle 27 and slot 13 provides unexpected efficiency in transmittal of force to a stake engaged by slot 13.

Figures 3, 4:
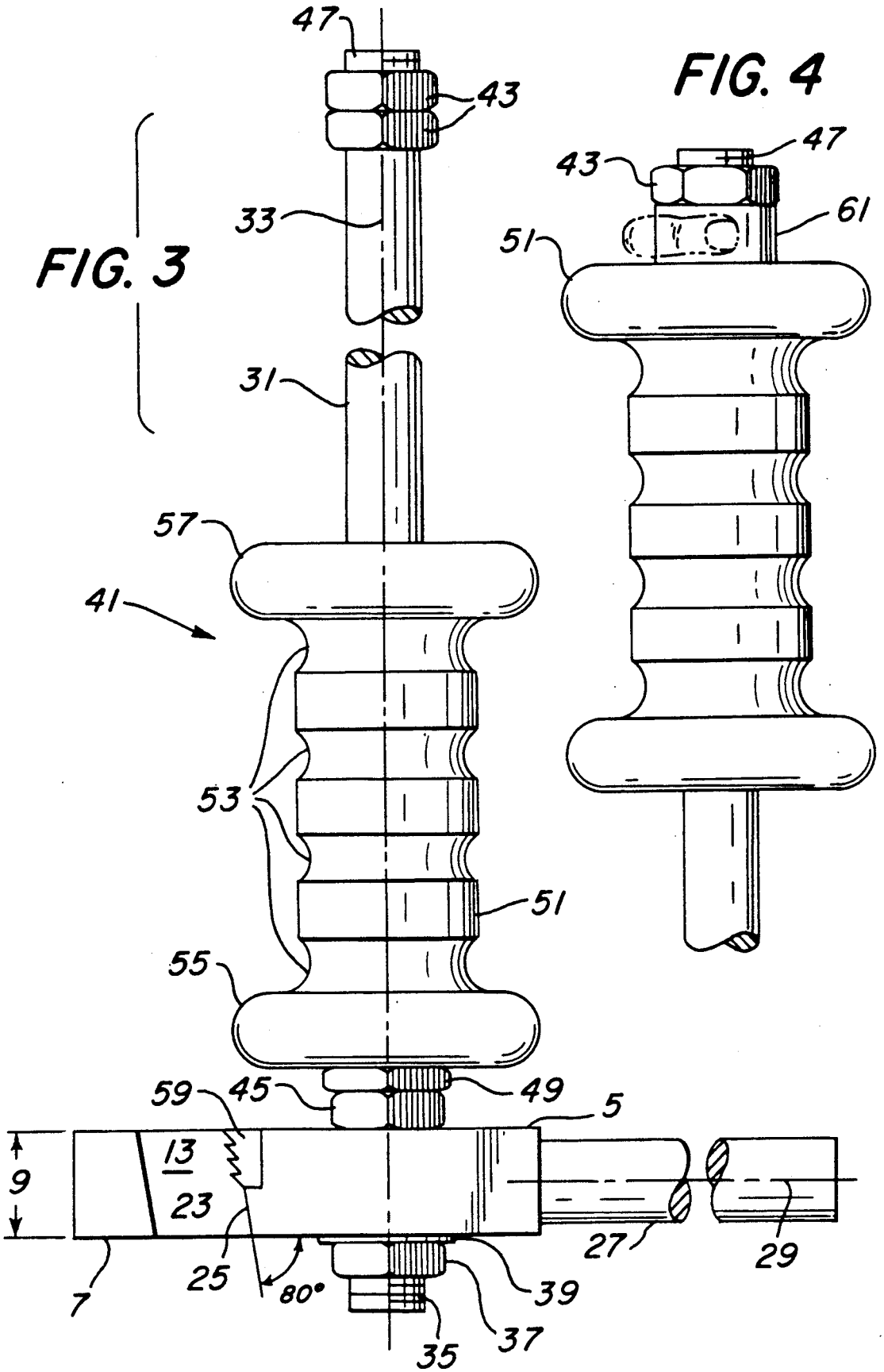
FIG. 3 is a front elevational view of FIG. 1.
FIG. 4 is a side elevational view of an alternate embodiment, incorporating a safety stop on the slide bar.

As shown in FIG. 3, slot 13 has a pair of sidewalls 23 and 25. I prefer to slope sidewalls downwardly at an angle from top surface 5 toward bottom surface 7, when viewed from a front elevational view. Side walls 23 and 25 are inclined downwardly toward slide bar 31 and handle 27. Slot 13 should be 1 1/16 inch wide (in horizontal width) to pull stakes from ⅝ inch to 1 inch in diameter. I prefer an angle between sidewall 25 and a horizontal plane, such as bottom plane 7, to be about 80 degrees. Slight variations in this angle are acceptable. The horizontal width of slot 13 is such that the angled relationship of sidewalls 23, 25 requires a tilting of base member 3 out of a horizontal position to permit slot 13 to move around the body of a stake (not shown) to be removed. When base member 3 is moved back toward a horizontal position by upward force on handle 27, sidewalls 23 and 25 frictionally engage the body of a stake, thereby fixing it into position in the stake remover to accept the force transmitted by slide means 41.

In an alternate embodiment (as shown in FIG. 3) hardened steel gripping teeth 59 can be removably inserted into wall 25 by conventional means, such as a keyway slot, in order to enhance the gripping ability of the device.

In a further alternate embodiment show in FIG. 4, a bushing 61 is threadably attached to end 47 between stop 43 and hammer head 51, to act as a stop for the hammer head 51. Bushing 61 is of sufficient length to permit a finger to be inserted into the space between hammer head 51 and stop 43 without injury.

I claim:

1. A stake puller comprising:

a. a horizontal planar base member having a thickness formed by a perimeter side portion;

b. a slot through said thickness of said base member, extending linearly from an open end at a first perimeter side portion and terminating adjacent a second perimeter side portion;

c. a horizontally extending elongated handle attached to said base member, said handle having a centerline passing substantially through the center of said base member and perpendicular to the linear direction of said slot, said centerline located on a horizontal plane substantially parallel to the plane of said base member;

d. an elongated tubular slide bar affixed to said base member between said slot and said handle, said slide bar extending vertically upward from said base member, said slide bar having a vertical centerline at substantially a right angle to said base member, said centerlines of said handle and said slide bar being located in substantially the same vertical plane; and e. hammer means slidably telescoped on said slide bar for reciprocating back and forth between a pair of oppositely spaced stops on said slide bar.

2. The invention of claim 1 in which said slot has an open end at said first perimeter side portion and a closed end adjacent to said second perimeter side portion.

3. The invention of claim 2 in which said slot has a pair of oppositely-spaced, sidewalls, sloping downwardly at an angle from a horizontal plane, said angle being about eighty degrees.

4. The invention of claim 3 in which gripping teeth are removably inserted into a sidewall of said slot.

5. The invention of claim 4 in which a bushing is attached to a top end of said slide bar between a stop at a top end of said slide bar and a hammer head slidably mounted on said slide bar.

6. A stake puller comprising:

a. a horizontal planar base member comprising: a top surface; a bottom surface substantially parallel thereto; and, a thickness formed by a side perimeter surface extending between said top surface and bottom surface;

b. a slot through said thickness of said base member, extending linearly from a first perimeter side portion toward a second perimeter side portion, said slot having an open end at said first perimeter side portion, a closed end adjacent to said second perimeter side portion, and a pair of spaced apart, parallel, angled sidewalls between said open and closed ends;

c. a horizontally extending elongated handle attached to said base member, said handle having a centerline passing substantially through the center of said base member, said centerline located on a horizontal plane substantially parallel to the plane of said base member;

d. an elongated tubular slide bar attached to said base member between said slot and handle, said slide bar extending vertically upward from said base member, said slide bar having a vertical centerline at substantially a right angle to said top surface, said centerlines of said handle and said slide bar being located in substantially the same vertical plane; and e. hammer means slidably telescoped on said slide bar for reciprocating back and forth between a pair of oppositely spaced anvils on said slide bar.

* * * * *